US010926540B2

(12) United States Patent
Mizukami et al.

(10) Patent No.: US 10,926,540 B2
(45) Date of Patent: Feb. 23, 2021

(54) LIQUID DISCHARGE HEAD, LIQUID DISCHARGE DEVICE, LIQUID DISCHARGE APPARATUS, METHOD FOR MANUFACTURING LIQUID DISCHARGE HEAD

(71) Applicants: Satoshi Mizukami, Kanagawa (JP); Takahiko Kuroda, Hyogo (JP)

(72) Inventors: Satoshi Mizukami, Kanagawa (JP); Takahiko Kuroda, Hyogo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/524,356

(22) Filed: Jul. 29, 2019

(65) Prior Publication Data

US 2020/0039227 A1 Feb. 6, 2020

(30) Foreign Application Priority Data

Jul. 31, 2018 (JP) ..... JP2018-144148

(51) Int. Cl.
*B41J 2/175* (2006.01)
*B41J 2/16* (2006.01)
*B41J 2/14* (2006.01)

(52) U.S. Cl.
CPC ..... *B41J 2/1642* (2013.01); *B41J 2/161* (2013.01); *B41J 2/162* (2013.01); *B41J 2/1606* (2013.01); *B41J 2/1623* (2013.01); *B41J 2/1626* (2013.01); *B41J 2/14233* (2013.01)

(58) Field of Classification Search
CPC . B41J 2/175; B41J 2/17596; B41J 2/19; B41J 29/02; B41J 29/38; B41J 2/18
See application file for complete search history.

(56) References Cited

U.S. PATENT DOCUMENTS

| | | | |
|---|---|---|---|
| 2014/0267497 | A1 | 9/2014 | Takagi et al. |
| 2014/0375725 | A1 | 12/2014 | Sameshima et al. |
| 2017/0043580 | A1 | 2/2017 | Takagi et al. |
| 2019/0176469 | A1 | 6/2019 | Kuroda et al. |

FOREIGN PATENT DOCUMENTS

| | | |
|---|---|---|
| JP | 2004-098310 | 4/2004 |
| JP | 2012-091381 | 5/2012 |
| JP | 2014-070185 | 4/2014 |
| JP | 2014-198460 | 10/2014 |

*Primary Examiner* — Lamson D Nguyen
(74) *Attorney, Agent, or Firm* — Oblon, McClelland, Maier & Neustadt, L.L.P.

(57) ABSTRACT

A liquid discharge head includes a channel forming member made of silicon, the channel forming member including a plurality of liquid channels, a natural oxide film having a film thickness of 2 nm or more on an outermost surface of the plurality of liquid channels of the channel forming member, and a surface treatment film on the natural oxide film to contact the natural oxide film. Each of a carbon content and a fluorine content in an interface between the natural oxide film and the surface treatment film is 5 atomic % or less.

14 Claims, 10 Drawing Sheets

LIQUID DISCHARGE HEAD, LIQUID DISCHARGE DEVICE, LIQUID DISCHARGE APPARATUS, METHOD FOR MANUFACTURING LIQUID DISCHARGE HEAD

CROSS-REFERENCE TO RELATED APPLICATIONS

This patent application is based on and claims priority pursuant to 35 U.S.C. § 119(a) to Japanese Patent Application No. 2018-144148, filed on Jul. 31, 2018 in the Japan Patent Office, the entire disclosure of which is hereby incorporated by reference herein.

BACKGROUND

Technical Field

The present disclosure relates to a liquid discharge head, a liquid discharge device, a liquid discharge apparatus, and a method for manufacturing a liquid discharge head.

Related Art

A highly reliable liquid discharge head is required in the industrial and commercial printing fields.

A nozzle substrate is bonded to a chamber substrate with adhesive. The chamber substrate is made of single-crystal silicon (Si), and a surface treatment film is formed on the chamber substrate.

However, adhesion between the chamber substrate and the surface treatment film is poor. Thus, initial failure or reliability failure may occur in a liquid discharge head using the nozzle substrate bonded to the chamber substrate. In the worst case, the surface treatment film may be peeled off from a surface of the chamber substrate during bonding the nozzle substrate to the chamber substrate. Thus, stable quality may not be obtained.

Therefore, it is necessary to perform heat cycle tests, for example, on actual products and to select conforming products that cause problems of man-hour increase, yield decrease, and cost increase. If the adhesion of the surface treatment film on a surface of a channel forming member that forms a liquid channel is poor, the liquid discharge head using the channel forming member may not obtain sufficient quality and reliability. The chamber substrate and the nozzle substrate are examples of the channel forming member.

SUMMARY

In an aspect of this disclosure, a liquid discharge head includes a channel forming member made of silicon, the channel forming member including a plurality of liquid channels, a natural oxide film having a film thickness of 2 nm or more on an outermost surface of the plurality of liquid channels of the channel forming member, and a surface treatment film on the natural oxide film to contact the natural oxide film. Each of a carbon content and a fluorine content in an interface between the natural oxide film and the surface treatment film is 5 atomic % or less.

BRIEF DESCRIPTION OF THE DRAWINGS

The aforementioned and other aspects, features, and advantages of the present disclosure will be better understood by reference to the following detailed description when considered in connection with the accompanying drawings, wherein.

Figure 1:
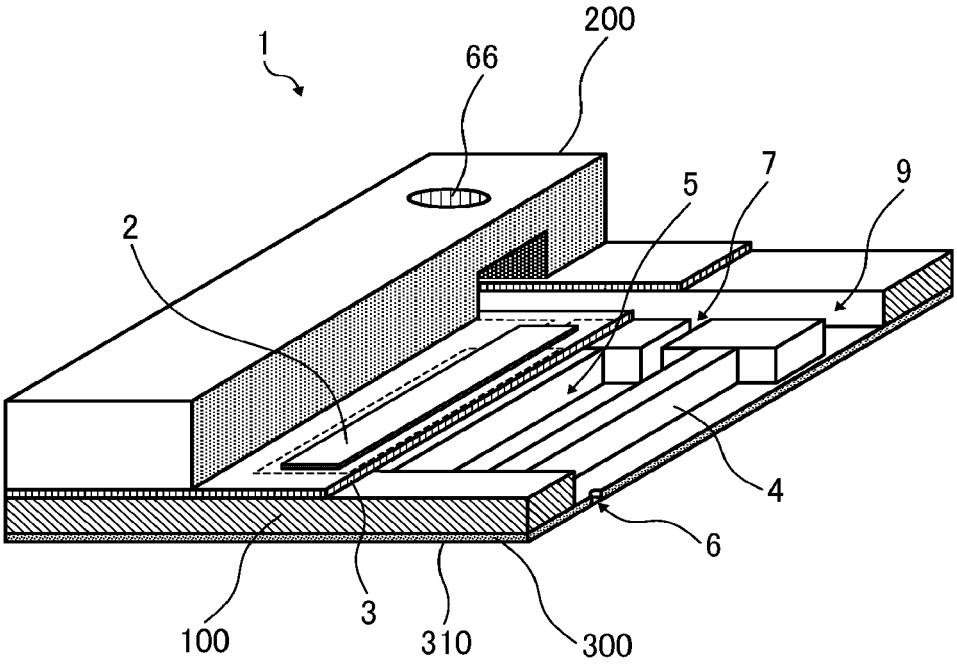
FIG. 1 is a perspective view of an example of a liquid discharge head according to the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that have the same function, operate in an analogous manner, and achieve similar results.

Although the embodiments are described with technical limitations with reference to the attached drawings, such description is not intended to limit the scope of the disclosure and all the components or elements described in the embodiments of this disclosure are not necessarily indispensable. As used herein, the singular forms "a", "an", and "the" are intended to include the plural forms as well, unless the context clearly indicates otherwise.

Hereinafter, a liquid discharge head, a liquid discharge device, a liquid discharge apparatus, and a method for manufacturing a liquid discharge head according to the present disclosure is described with reference to the drawings. Note that the present disclosure is not limited to the following embodiments and may be other embodiments. The following embodiments may be modified by, e.g., addition, modification, or omission within the scope that would be obvious to one skilled in the art. Any aspects having advantages as described for the following embodiments according to the present disclosure are included within the scope of the present disclosure.

A liquid discharge head according to the present disclosure includes a channel forming member to form a channel of liquid. The channel forming member is made of Si, and natural oxide film having a film thickness of 2 nm or more is formed on an outermost surface of the channel forming member. A surface treatment film is formed on and in contact with the natural oxide film. Each of a C content (content of carbon) and an F content (content of fluorine) in an interface between the natural oxide film and the surface treatment film is respectively 5 atomic % or less.

[Liquid Discharge Head]

The term "liquid discharge head" used herein is a functional component to discharge a liquid from nozzles. Hereinafter, a "liquid discharge head" is simply referred to as a "head".

Further, "liquid" discharged from the head is not particularly limited as long as the liquid has a viscosity and surface tension of degrees dischargeable from the head. However, preferably, the viscosity of the liquid is not greater than 30 mPa·s under ordinary temperature and ordinary pressure or by heating or cooling.

Examples of the liquid include a solution, a suspension, or an emulsion that contains, for example, a solvent, such as water or an organic solvent, a colorant, such as dye or pigment, a functional material, such as a polymerizable compound, a resin, or a surfactant, a biocompatible material, such as DNA, amino acid, protein, or calcium, or an edible material, such as a natural colorant.

Such a solution, a suspension, or an emulsion can be used for, e.g., inkjet ink, surface treatment solution, a liquid for forming components of electronic element or light-emitting element or a resist pattern of electronic circuit, or a material solution for three-dimensional fabrication.

Examples of an energy source to generate energy to discharge liquid include a piezoelectric actuator (a laminated piezoelectric element or a thin-film piezoelectric element), a thermal actuator that employs a thermoelectric conversion element, such as a heating resistor, and an electrostatic actuator including a diaphragm and opposed electrodes.

[Basic Configuration of Liquid Discharge Head]

A basic configuration of the liquid discharge head according to the present disclosure is described below.

Figure 2:
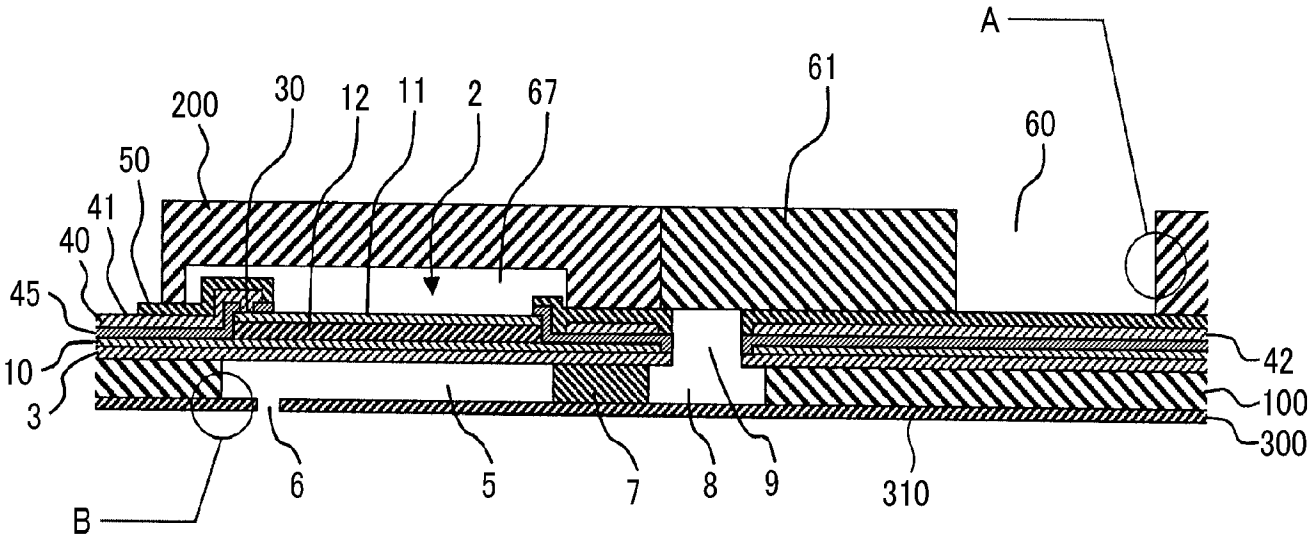
FIG. 2 is a cross-sectional view in a longitudinal direction of a liquid chamber in an example of the liquid discharge head according to the present disclosure.
Figure 3:
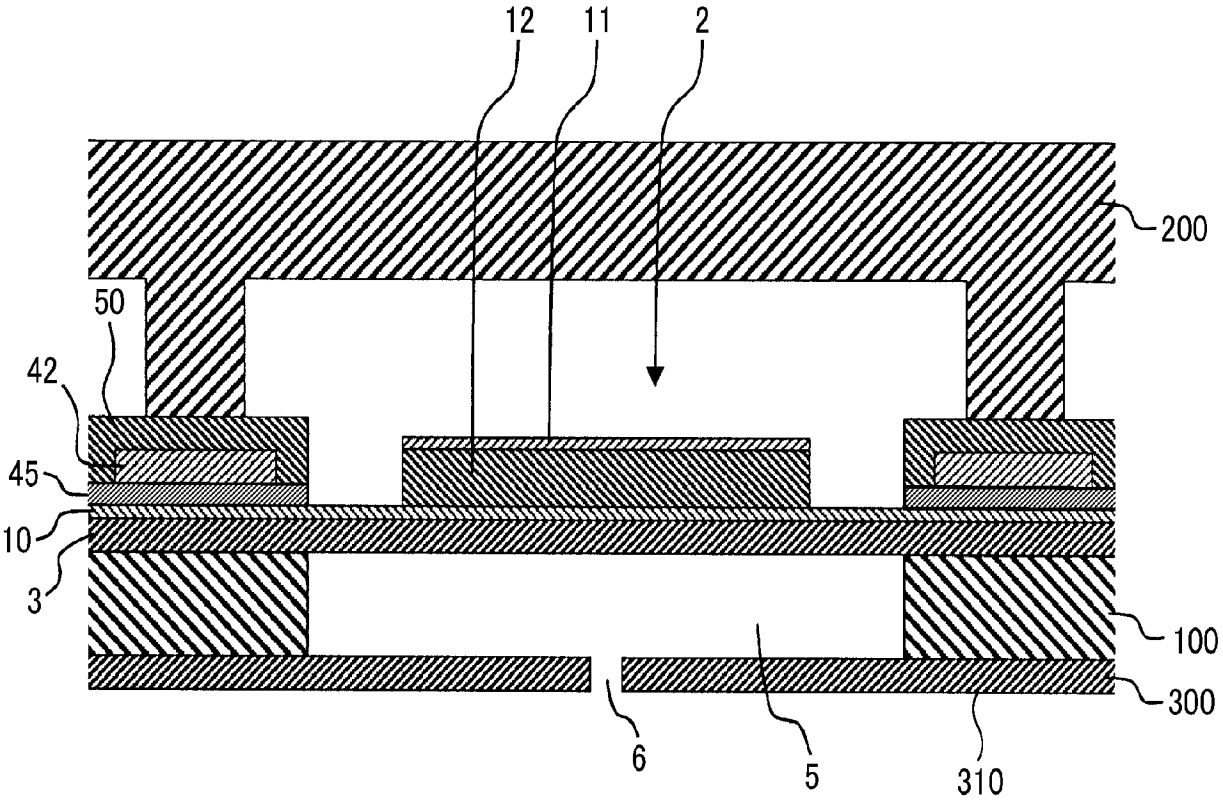
FIG. 3 is a cross-sectional view in a transverse direction of the liquid chamber in an example of the liquid discharge head according to the present disclosure.

FIG. 1 is a perspective view of the liquid discharge head according to the present disclosure. FIG. 2 is a schematic cross-sectional view in a longitudinal direction of a liquid chamber in FIG. 1. FIG. 3 is a schematic cross-sectional view in a transverse direction of the liquid chamber in FIG. 1. The liquid discharge head according to the present disclosure includes a piezoelectric actuator.

The head 1 illustrated in FIGS. 1 to 3 is of a side-shooter type that discharges a liquid from nozzles formed in a surface of a substrate. The head 1 includes a piezoelectric element 2 to generate energy to discharge the liquid and a diaphragm 3 on an actuator substrate 100. A partition 4, a pressure chamber 5, a fluid restrictor 7, and a common chamber 8 are formed in the actuator substrate 100. Each pressure chambers 5 is partitioned by partitions 4.

The sub-frame substrate 200 includes a supply port 66, a common supply channel 9, and a gap 67. The supply port 66 and the common supply channel 9 supply the liquid to the head 1 from outside the head 1. The gap 67 is formed in a sub-frame substrate 200 to enable the diaphragm 3 to bend. Further, nozzles 6 are formed in a nozzle substrate 300 at positions corresponding to the respective pressure chambers 5. A passivation film 50 is formed on the actuator substrate 100 to protect a lead-out wiring layer. The actuator substrate 100, the sub-frame substrate 200, and the nozzle substrate 300 are bonded to form the head 1.

As illustrated in FIGS. 1 and 2, the actuator substrate 100 includes the diaphragm 3, and the piezoelectric element 2. The diaphragm 3 forms a part of wall of the pressure chamber 5. The piezoelectric element 2 is disposed to face the pressure chamber 5 via the diaphragm 3. Further, the common supply channel 9 is formed in the diaphragm 3 at a position facing the common chamber 8, and the liquid can be supplied from outside the head 1 from the common supply channel 9 and the common chamber 8. As illustrated in FIG. 2, the piezoelectric element 2 formed on the side facing the pressure chamber 5 via the diaphragm 3 is configured of a common electrode 10, an individual electrode 11, and a piezoelectric body 12.

The head 1 configured as described above fills a liquid, for example, a recording liquid (ink) in each pressure chambers 5. The head 1 applies a pulse voltage of 20 V, for example, generated by an oscillation circuit to the piezoelectric body 12 via an individual electrode 11 corresponding to the nozzle 6 from which the liquid is to be discharged, through a lead wire 40 and a connection hole 30 formed in an interlayer insulating film 45 based on image data sent from a controller when each of the pressure chambers 5 is filled with the liquid.

Application of the pulse voltage makes the piezoelectric body 12 contracting in a direction parallel to the diaphragm 13 due to electrostrictive effect, and the diaphragm 3 bends toward the pressure chamber 5. Thus, a pressure in the pressure chamber 5 rises sharply, and the recording liquid is discharged from the nozzles 6 communicating with the pressure chambers 5.

After the application of the pulse voltage, the contracted piezoelectric body 12 returns to an original position, and the bent (deflected) diaphragm 13 returns to an original position. Negative pressure lower than the pressure in the common chamber 8 is generated in the pressure chamber 5, and the ink outside the head 1 is supplied to the pressure chamber 5 through a supply port 66, the common supply channel 9, the common chamber 8, and the fluid restrictor 7 from outside the head 1.

Repeating the above-described processes, the head 1 can continuously discharge the liquid and forms an image on a recording medium (sheet) arranged opposite to the head 1.

[Example of Liquid Discharge Head According to Present Disclosure]

Next, details of the head 1 according to the present disclosure is described while describing a method for manufacturing the head.

The method for manufacturing the head 1 includes processes of: forming a natural oxide film 32 (see FIGS. 5 to 7) having a film thickness of 2 nm or more in the channel in the channel forming member 31, removing contaminants on a surface of the channel forming member 31, and forming a surface treatment film 52 (see FIGS. 4A and 4B, and FIGS. 5 to 7) on the natural oxide film 32. The method for manufacturing the head 1 may include other processes as needed.

Further, a channel forming member 31 is used to form a liquid channel. The sub-frame substrate 200, the actuator substrate 100, and the nozzle substrate 300 are one of the example of the channel forming member 31.

First, the diaphragm 3 and the piezoelectric element 2 are formed on the actuator substrate 100 as illustrated in FIG. 2 and the like by a known method. Next, the interlayer insulating film 45, the connection hole 30, the wiring pattern 42, the lead wire 40, and the lead wiring pad 41 are formed by a known method.

Next, through holes 60 and gaps 67 are formed in the sub-frame substrate 200, for example, by a photolithographic etching. A silicon substrate (Si substrate) is preferably used as the sub-frame substrate 200.

Next, the sub-frame substrate 200 and the actuator substrate 100 are bonded. The method of bonding the sub-frame substrate 200 and the actuator substrate 100 is not particularly limited, and may be appropriately changed.

Either the process of the actuator substrate 100 or the process of the sub-frame substrate 200 may be performed first in the above-described processes.

Next, the pressure chamber 5 is formed in the actuator substrate 100. An Inductive Coupled Plasma (ICP) etcher, for example, is used to form the pressure chamber 5 in the actuator substrate 100. Specifically, the actuator substrate 100 is processed by dry etching using carbon tetrafluoride gas ($CF_4$ gas), for example, to form the pressure chamber 5. However, the above-described process has a problem of carbon (C) and fluorine (F) remained as contaminants on the surface of the actuator substrate 100 after a formation of the pressure chamber 5.

A single crystal Si substrate is preferably used as the channel forming member 31 according to the present disclosure. The single crystal Si substrate is suitable for a microfabrication technology with increase in a precision and a density of the head 1. When the single crystal Si substrate is used, contaminants such as carbon (C) and fluorine (F) are adhered to the surface of the channel forming member 31 because a surface of the single crystal Si substrate as the channel forming member 31 may be contaminated during a polishing process or an etching process before the surface treatment film is formed on the single crystal Si substrate.

If the contaminants is not sufficiently removed from the single crystal Si substrate, a formation of strong siloxane bonds (Si—O—Si bonds) in the channel forming member 31 and the surface treatment film is inhibited. Thus, the adhesion at the interface is reduced, and defects such as film peeling are likely to occur as a whole.

Conversely, the method for manufacturing the head 1 in the present disclosure forms a natural oxide film 32 on a surface of a channel forming member 31 to remove carbon (C) and fluorine (F) on a surface of the channel forming member 31 and to oxidize the surface of the channel forming member 31, particularly the channel forming member 31 made of Si.

The natural oxide film 32 may contain $SiO_2$, for example. Forming the natural oxide film 32 can remove contaminants such as carbon (C) and fluorine (F). Thus, the method according to the present disclosure can remove factors that inhibits the siloxane bonds (Si—O—Si bonds). Further, natural oxidation of the channel forming member 31 can improve adhesion between the surface of the channel forming member 31 and the surface treatment film 52 than silicon (Si).

The natural oxide film 32 is formed by an $O_2$ plasma processing in an ICP etcher. The film thickness of the natural oxide film 32 is preferably 2 nm or more. If the film thickness of the natural oxide film 32 is less than 2 nm, contaminants such as carbon (C) and fluorine (F) may not be sufficiently removed.

Thus, the $O_2$ plasma processing in an ICP etcher can form the natural oxide film 32 and remove the contaminants such as carbon (C) and fluorine (F) at the same time (at one time).

Figure 6:
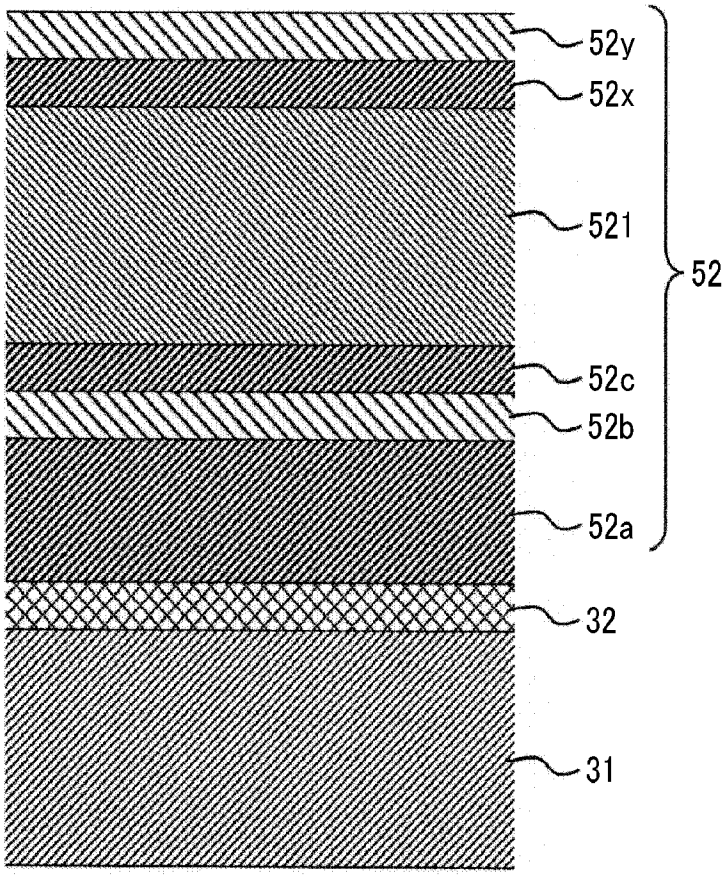
FIG. 6 is a cross-sectional view of another example of the surface treatment film.
Figure 5:
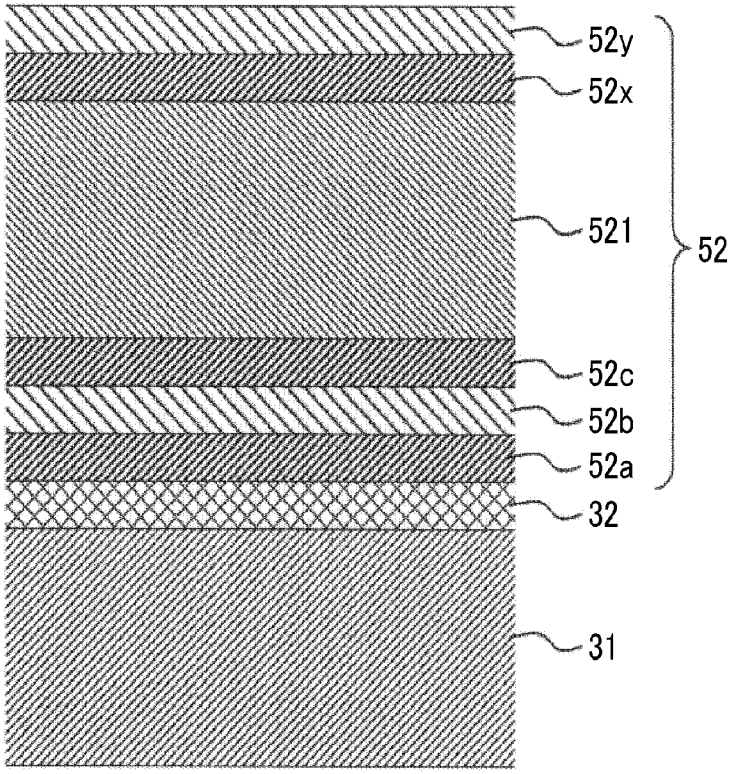
FIG. 5 is a cross-sectional view of an example of a surface treatment film.

Next, the surface treatment film 52 is formed on the natural oxide film 32 (see FIGS. 5 and 6). Formation of the surface treatment film 52 can secure liquid resistance of the channel forming member 31. Further, the surface treatment film 52 can prevent deterioration of the channel forming member 31 caused by contacting the liquid.

The head 1 according to the present disclosure includes the natural oxide film 32 formed on an outermost surface of the channel forming member 31 (the actuator substrate 100, the sub-frame substrate 200, and the nozzle substrate 300) and the surface treatment film 52 formed on the natural oxide film 32.

The outermost surface of the channel forming member 31 (the actuator substrate 100, the sub-frame substrate 200, and the nozzle substrate 300) is oxidized to form a natural oxide film 32, and the surface treatment film 52 is the formed on the natural oxide film 32 to improve adhesion of an interface between the channel forming member 31 and the surface treatment film 52 for the channel forming member 31, in particular, a channel forming member 31 using Si.

A method of film-formation of the surface treatment film 52 can be appropriately changed. For example, an atomic layer deposition (ALD) method, a sputtering method, a chemical vapor deposition (CVD) method, and the like may be used for film-formation. Among the above-described methods for film-formation, the ALD method is preferable from a viewpoint of the coatability. The ALD method can form a uniform film on an uneven surface. Thus, the ALD method is advantageous because the ALD method can form a uniform film on a complicated structure.

The surface treatment film 52 may be formed in a liquid channel in the channel forming member 31, that is, in a portion of the channel forming member 31 that may contact the liquid. The portion of the channel forming member 31 to form the surface treatment film 52 may be appropriately changed within a range in which liquid resistance can be secured.

For example, the surface treatment film 52 may be formed on a surface of the through holes 60 and a surface of an individual through-hole portion 61 of the sub-frame substrate 200, both surfaces of the common supply channel 9, the common chamber 8, the fluid restrictor 7, and the pressure chamber 5, the nozzle substrate 300 of the actuator substrate 100, and a surface of the nozzles 6, and the like.

A surface of the sub-frame substrate 200 opposite to the actuator substrate 100 is protected with a support tape or the like to prevent formation of a film by the ALD method before the surface treatment film 52 is film-formed on the natural oxide film 32. Such protection with the support tape or the like also prevents a defect to occur such as a film formed by the ALD method is attached to the lead wiring pad 41 to hinder an electrical conduction of the lead wiring pad 41.

However, if the sub-frame substrate 200 to which the support tape or the like is attached is placed in the ALD chamber, contaminants such as carbon (C) is adhere to the surface of the channel forming member 31 due to influence of gas generated from the support tape. When the surface treatment film 52 is film-formed by the ALD method or the like in a state in which the contaminants such as C adhered on the channel forming member 31, the adhesion between the surface treatment film 52 and the channel forming member 31 is reduced.

Conversely, the method according to the present disclosure preforms an $O_3$ plasma processing in the ALD apparatus to remove carbon (C) to reduce the C content. Reducing the C content can prevent a decrease in an adhesion of film.

Timing of performing the $O_3$ plasma processing (treatment) may be appropriately changed. However, the $O_3$ plasma processing (treatment) is performed during the formation of the surface treatment film 52 in the present disclosure. The details of the $O_3$ plasma processing is described below together with the surface treatment film 52.

Next, the formation of the surface treatment film 52 is described below in detail.

Figure 4A:
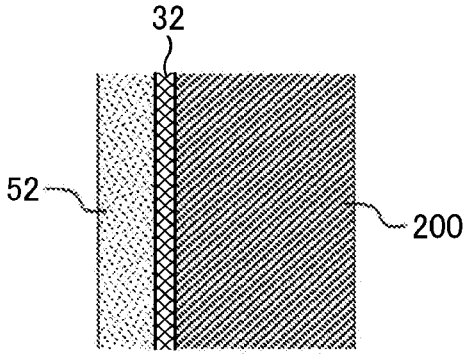
FIGS. 4A and 4B are partial enlarged views of an example of the liquid discharge head according to the present disclosure.

FIG. 4A is an enlarged schematic cross-sectional view of a region A in FIG. 2. FIG. 4A illustrates that the surface treatment film 52 is formed in a portion of the through hole 60 of the sub-frame substrate 200 in contact with the liquid. In FIG. 4A, the natural oxide film 32 is formed on the sub-frame substrate 200, and the surface treatment film 52 is formed on the natural oxide film 32.

The surface treatment film 52 is preferably an oxide film containing Si. Further, the interface between the surface treatment film 52 and channel forming member 31 is preferably siloxane bonded. The siloxane bonding of the interface improves the adhesion of the surface treatment film 52. It can be determined that whether the interface between the surface treatment film 52 and the channel forming member 31 is siloxane bonded by Energy Dispersive X-ray spectroscopy (EDX) analysis or X-ray photoelectron spectroscopy (XPS) analysis, for example.

The surface treatment film 52 preferably contains at least one transition metal selected from fourth group and fifth group. Thus, liquid resistance (ink resistance) of the surface treatment film 52 can be further improved. The surface treatment film 52 preferably contains at least one of Hf, Ta, and Zr among the transition metal selected from fourth groups and fifth group. Thus, the liquid resistance of the surface treatment film 52 can be further improved.

The surface treatment film 52 preferably has a Ta—Si bonding state. The Ta—Si bonding state can further strengthen the bonding of the interface between the surface treatment film 52 and the channel forming member 31 and can further improve the adhesion of the surface treatment film 52. The binding state can be identified by X-ray Photoelectron Spectroscopy (XPS) analysis.

The thickness of the surface treatment film 52 is preferably 30 to 100 nm. In the thickness of the surface treatment film 52 is 30 nm or more, the surface treatment film 52 can secure sufficient ink resistance. If the thickness of the surface treatment film 52 is 100 nm or less, the surface treatment film 52 can reduce influence of stress and easily prevent an occurrence of film peeling at the interface between the channel forming member 31 and the surface treatment film 52.

Next, an example of the surface treatment film 52 is described below. FIGS. 5 and 6 are schematic cross-sectional views of an example of the surface treatment film 52. As illustrated in FIGS. 5 and 6, the natural oxide film 32 is formed on the outermost surface of the channel forming member 31, and the surface treatment film 52 is formed on the natural oxide film 32.

Following describes an example of the surface treatment film 52 in which a $SiO_2$ film and a $Ta_2O_5$ film are alternately formed (laminated) by the ALD method. The ALD method can digitally film-form a film to be formed for each molecular layers.

Although the film for each molecular layers should ideally be formed uniformly on a surface of the channel forming member 31 to be formed, the film for each molecular layers is actually film-formed in an island shape because of variations in surface energy.

Therefore, a $SiO_2$ film and a $Ta_2O_5$ film film-formed in island shape are mixed at the interface between the channel forming member 31 and the surface treatment film 52. The adhesion depends on a ratio of the contact area of the interface between the $SiO_2$ film and the $Ta_2O_5$ film.

Usually, a step of forming the $Ta_2O_5$ film is performed after performing a step of forming the $SiO_2$ film. The above-described steps of film-forming are alternately performed for each steps. To increase the Si content, the $SiO_2$ film may be continuously film-formed for a plurality of steps. That is, the Si content can be adjusted by changing a number of steps of film-forming.

Further, it is preferable to form a surface treatment film 52 from a $SiO_2$ film on the natural oxide film 32 on the outermost surface of the channel forming member 31 that becomes a first layer of the $SiO_2$ film 52*a*. The natural oxide film 32 becomes a base of the surface treatment film 52.

The above-described formation of the $SiO_2$ film on the natural oxide film 32 can increase the adhesion since a strong siloxane bond (Si—O—Si bond) is formed in the interface between the channel forming member 31 and the surface treatment film 52. Thus, the interface between the natural oxide film 32 and the surface treatment film 52 is siloxane bonded.

The film thickness of the first layer of $SiO_2$ film 52*a* is preferably from 0.1 to 10 nm, and is more preferably from 1 to 10 nm, and is still more preferably 2 to 4 nm. The first layer of $SiO_2$ film 52*a* having a film thickness within above-described range can strengthen the siloxane bond at the interface between the channel forming member 31 and the surface treatment film 52 and increase adhesion of the surface treatment film 52.

FIG. 5 is an example in which the film thickness of the first layer of $SiO_2$ film 52*a* is from 0.1 to 2 nm. FIG. 6 is an example in which the film thickness of the first layer of $SiO_2$ film 52*a* is from 2 to 4 nm.

As illustrated in FIG. 5, it is preferable to film-form a first-layer of $SiO_2$ film 52*a* on the natural oxide film 32 first, and then alternately film-form a $Ta_2O_5$ film 52*b*, a $SiO_2$ film 52*c*, a mixed layer 521 (alternately formed layers of a $SiO_2$ film and a $Ta_2O_5$ film), a $SiO_2$ film 52*x*, and a $Ta_2O_5$ film 52*y*. The alternately laminated layers of the $SiO_2$ film and the $Ta_2O_5$ film becomes a mixed layer 521 of the $SiO_2$ film and the $Ta_2O_5$ film as described below. The above-described film-formation of a $SiO_2$ film and a $Ta_2O_5$ film can further increase the adhesion of the surface treatment film 52.

The $O_3$ plasma processing (treatment) in the present disclosure is performed during the film formation of the surface treatment film 52. Specifically, the $O_3$ plasma processing (treatment) is performed before film-forming the $SiO_2$ film of the surface treatment film 52. When the $SiO_2$ film and the $Ta_2O_5$ film are alternately laminated (film-formed), the $O_3$ plasma processing (treatment) may be performed every time before film-forming the $SiO_2$ film after forming the $Ta_2O_5$ film.

Normally, $O_3$ is supplied for each molecular layers. In the present embodiment, the $O_3$ plasma processing (treatment) is performed on the surface of the channel forming member 31 to reduce the C content.

Figure 7:
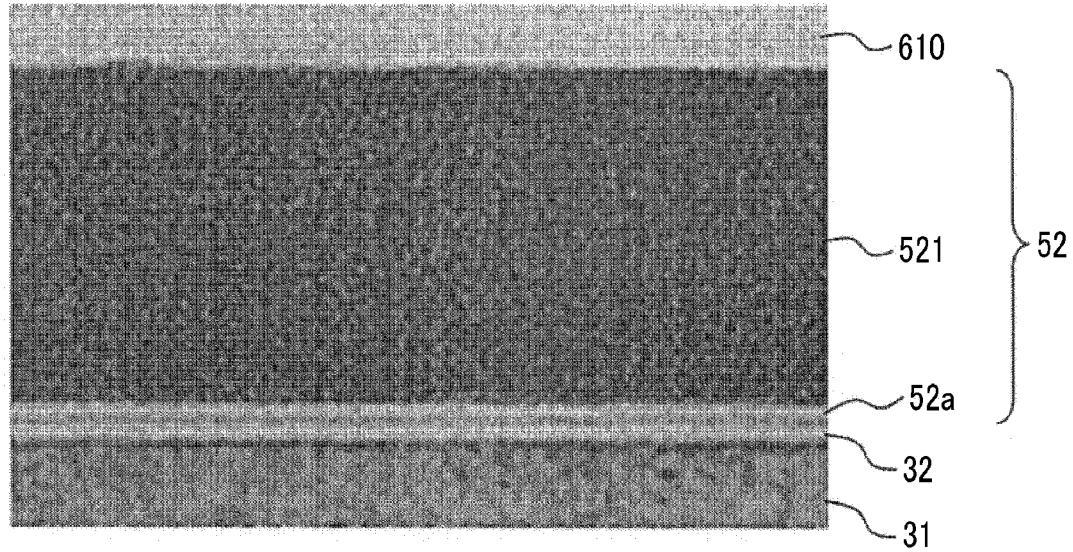
FIG. 7 is a Transmission Electron Microscope (TEM) image of an example of the surface treatment film.

FIG. 7 is an example of a cross-sectional observation image by Transmission Electron Microscope (TEM) in the present disclosure. In FIG. 7, the natural oxide film 32 is formed on the channel forming member 31, and the first layer of $SiO_2$ film 52*a* is formed on the natural oxide film 32. The $SiO_2$ film and the $Ta_2O_5$ film are alternately laminated after the formation of the first layer of $SiO_2$ film 52*a*.

However, as illustrated in FIG. 7, alternately laminated layers of the $SiO_2$ film and the $Ta_2O_5$ film becomes a mixed layer 521 of the $SiO_2$ film and the $Ta_2O_5$ film. Further, the mixed layer 521 is observed as $TaSiO_X$ also in an X-ray Photoemission Spectroscopy (XPS) analysis. Thus, it can be seen that the film is obtained in a Ta—Si bonding state.

Next, a natural oxide film 32 and a surface treatment film 52 are formed on the nozzle substrate 300 in which the nozzles 6 are formed in the same manner as described above. Note that the process of forming the natural oxide film 32 and the surface treatment film 52 on the nozzle substrate 300 may be performed before the above-described process.

Then, the nozzle substrate 300 on which the natural oxide film 32 and the surface treatment film 52 are formed is bonded to the actuator substrate 100 obtained in the above-described process. The bonding of the nozzle substrate 300 and the actuator substrate 100 may be performed by a known method. In the present disclosure, an adhesive is used to bond the nozzle substrate 300 and the actuator substrate 100.

Figure 4B:
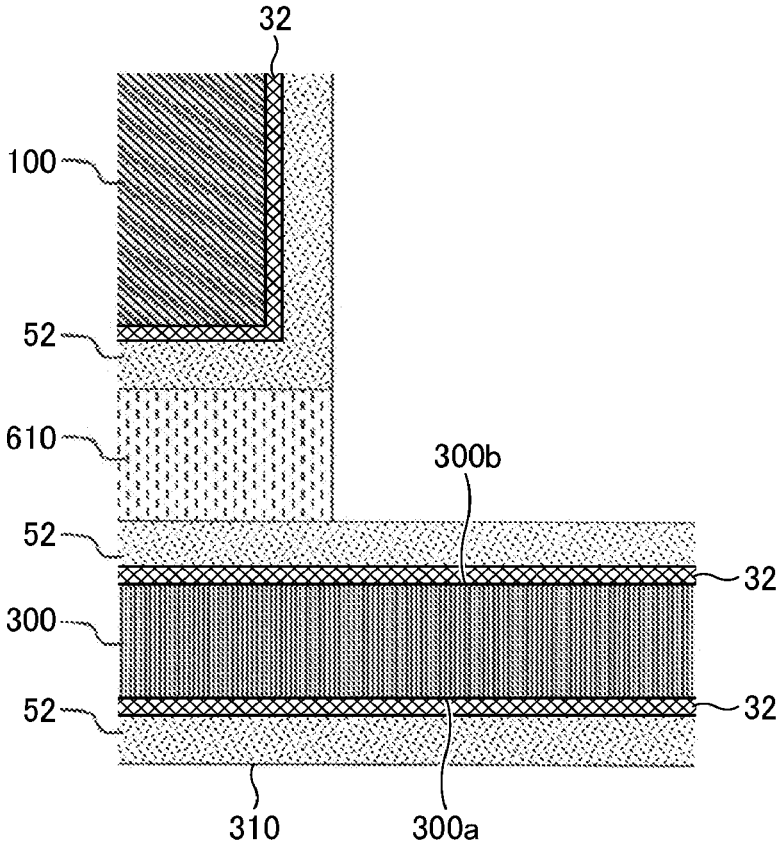

FIG. 4B is an enlarged schematic cross-sectional view of a region B in FIG. 2. In FIG. 4B, the surface treatment film 52 is formed on the surface of the actuator substrate 100 and the surface of the nozzle substrate 300. The actuator substrate 100 and the nozzle substrates 300 are bonded via an adhesive 610. In FIG. 4A, the natural oxide film 32 is formed between the actuator substrate 100 and the surface treatment film 52 and is formed between the nozzle substrate 300 and the surface treatment film 52.

The surface treatment film 52 is also formed on a region (inner surface 300*b*) of the nozzle substrate 300 that contacts the liquid. The nozzle substrate 300 is one of the channel forming member 31 in the present disclosure. Further, the surface treatment film 52 is also formed on an outer surface 300*a* that is a surface on a nozzle surface 310 side of the nozzle substrate 300 in the present disclosure.

The nozzle surface 310 is disposed outside the head 1 and opposite to the inner surface 300*b* bonded to the actuator substrate 100. However, the region (surface) of the channel forming member 31 on which the surface treatment film 52 is formed is not limited to the embodiments as described above.

The head 1 according to the present disclosure includes a natural oxide film 32 having a film thickness of 2 nm or more on an outermost surface of a channel forming member 31. Further, the C content and the F content in the interface between the natural oxide film 32 and the surface treatment film 52 are respectively 5 atomic % or less. The method of determination of the film thickness of the natural oxide film 32, and determination of carbon (C) amount and fluorine (F) amount is described below.

A cross-section of the natural oxide film 32 and the surface treatment film 52 on the channel forming member 31 is observed by the Transmission Electron Microscope (TEM). Then, a thickness of the natural oxide film 32 on the Si substrate is measured. An Energy Dispersive X-ray Spectroscopy (EDS) analysis is performed to measure the C content and F content in the interface between the channel forming member 31 and the surface treatment film 52. The C content and the F content in all elements (mainly Si, Ta, O, C, and F) are determined and quantified.

The Energy Dispersive X-ray spectroscopy (EDX) analysis may also be similarly performed on the head 1 after bonding the nozzle substrate 300 and the like to determine the C content and the F content.

Further, the X-ray Photoelectron Spectroscopy (XPS) analysis may also be used to measure impurity such as the C content and the F content.

When the C content and the F content in the interface exceeds 5 atomic %, respectively, the adhesion of the surface treatment film 52 decreases and the reliability is of the surface treatment film 52 also decreases.

Another example of the method of manufacturing the head 1 according to the present disclosure may perform the $O_2$ plasma processing (treatment) before the formation of the surface treatment film 52. Then, the method removes carbon (C) and fluorine (F) attached to the surface of the channel forming member 31 during polishing and etching of the surface of the Si substrate.

Further, the method performs the $O_3$ plasma processing (treatment) during formation of the surface treatment film 52 to remove contaminants such as carbon (C) and fluorine (F) and to film-form the surface treatment film 52. Thus, the method can reduce the C content and the F content in the interface between the channel forming member 31 and the surface treatment film 52 to 5 atoms % or less. Thus, the method can secure adhesion in the interface and prevent occurrence of defects such as film peeling.

Further, the method can improve the adhesion between the channel forming member 31 and the surface treatment film 52, adhesion between the surface treatment film 52 and adhesive, or adhesion between the surface treatment film 52 and a water-repellent layer formed on the nozzle surface 310. Thus, the method as described above can improve quality and reliability of the head 1.

[Liquid Discharge Device]

Next, the liquid discharge device 440 according to the present disclosure is described with reference to FIGS. 8 to 10. The carriage 403 mounts a liquid discharge device 440.

The head 1 according to the present disclosure and a head tank 441 forms the liquid discharge device 440 as a single unit. The head 1 is identical to the head 1 as illustrated in FIGS. 1 to 7.

The head 1 is identical to the head 1 as described above. The head 1 of the liquid discharge device 440 discharges liquid of each color, for example, yellow (Y), cyan (C), magenta (M), and black (K). The head 1 includes a nozzle array including a plurality of nozzles arrayed in row in a sub-scanning direction perpendicular to a main scanning direction indicated by arrow MSD in FIG. 9. The head 1 is mounted to the carriage 403 so that ink droplets are discharged downward.

The pressure generator used in the "liquid discharge head" is not limited to a particular-type of pressure generator. The pressure generator is not limited to the piezoelectric actuator (or a laminated-type piezoelectric element) described in the above-described embodiments, and may be, for example, a thermal actuator that employs a thermoelectric transducer element, such as a thermal resistor or an electrostatic actuator including a diaphragm and opposed electrodes.

The terms "image formation", "recording", "printing", "image printing", and "fabricating" used herein may be used synonymously with each other.

The "liquid discharge device" is an assembly of parts relating to liquid discharge. The term "liquid discharge device" represents a structure including the head and a functional part(s) or mechanism combined to the head to form a single unit. For example, the "liquid discharge device" includes a combination of the head with at least one of a head tank, a carriage, a supply unit, a recovery device, and a main scan moving unit.

Examples of the "single unit" include a combination in which the head 1 and one or more functional parts and devices are secured to each other through, e.g., fastening, bonding, or engaging, and a combination in which one of the head 1 and the functional parts and devices is movably held by another. The head 1 may be detachably attached to the functional part(s) or unit(s) s each other.

Figure 8:
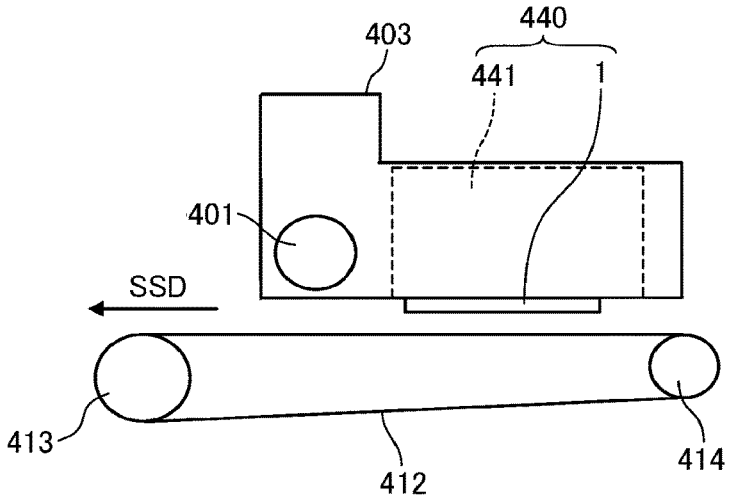
FIG. 8 is a schematic side view of an example of a liquid discharge device according to the present disclosure.

FIG. 8 is a side view of an example of the liquid discharge device 440 in which the head 1 and the head tank 441 form the liquid discharge device 440 as a single unit. Alternatively, the head 1 and the head tank 441 coupled (connected) with a tube or the like may form the liquid discharge device 440 as a single unit. Here, a unit including a filter may further be added to a part between the head tank 441 and the head 1.

In another example, the liquid discharge device 440 may include the head 1 and the carriage 403 to form a single unit.

In still another example, the liquid discharge device 440 includes the head 1 movably held by the guide 401 that forms part of a main scan moving unit 493 (see FIG. 9), so that the head 1 and the main scan moving unit 493 form a single unit.

Figure 9:
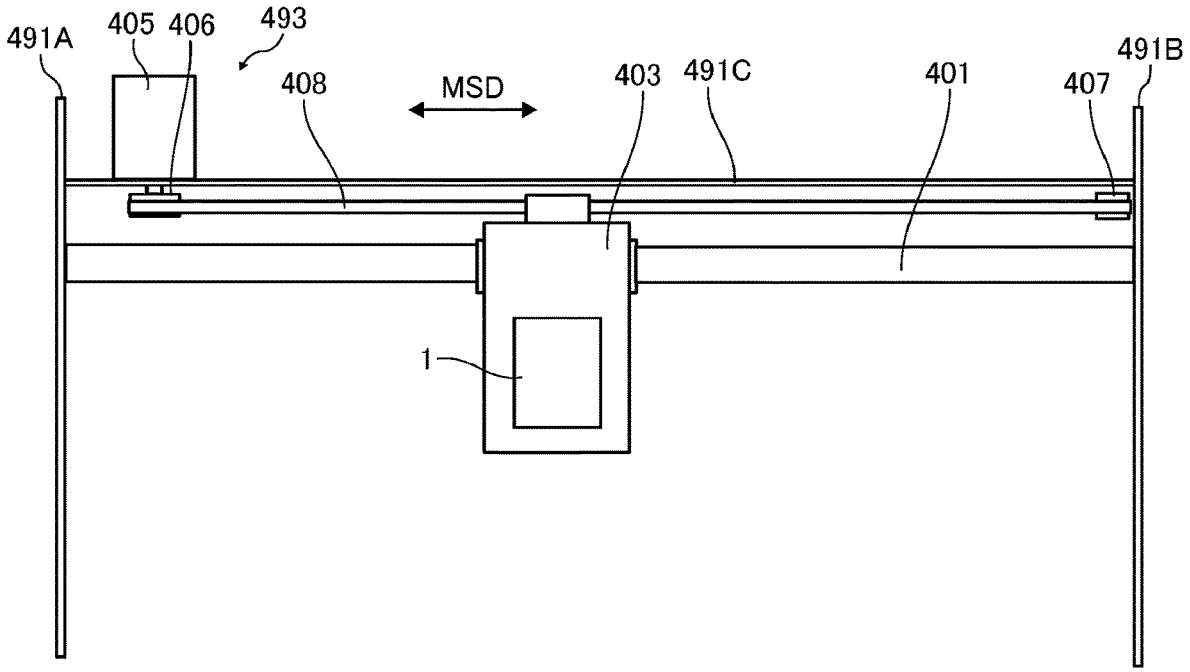
FIG. 9 is a schematic plan view of another example of the liquid discharge device according to the present disclosure.

FIG. 9 is a plan view of an example of the liquid discharge device 440 that includes the head 1, the carriage 403, and the main scan moving unit 493 that form a single unit.

The inkjet recording apparatus 90 is a serial type apparatus, and the carriage 403 reciprocally moves in the main scanning direction as indicated by arrow MSD by the main scan moving unit 493. The main scan moving unit 493 includes a guide 401, a main scanning motor 405, a timing belt 408, and the like. The main scan moving unit 493 functions as a drive device to move the carriage in the main scanning direction MSD. The guide 401 is bridged between the left-side plate 491A and right-side plate 491B to moveably hold the carriage 403. The main scanning motor 405 reciprocally moves the carriage 403 in the main scanning direction MSD via the timing belt 408 bridged between a driving pulley 406 and a driven pulley 407.

In still another example, a cap that forms part of a recovery device 127 (see FIG. 12) may be secured to the carriage 403 mounting the head 1 so that the head 1, the carriage 403, and the recovery device 127 form a single unit to form the liquid discharge device 440.

Figure 10:
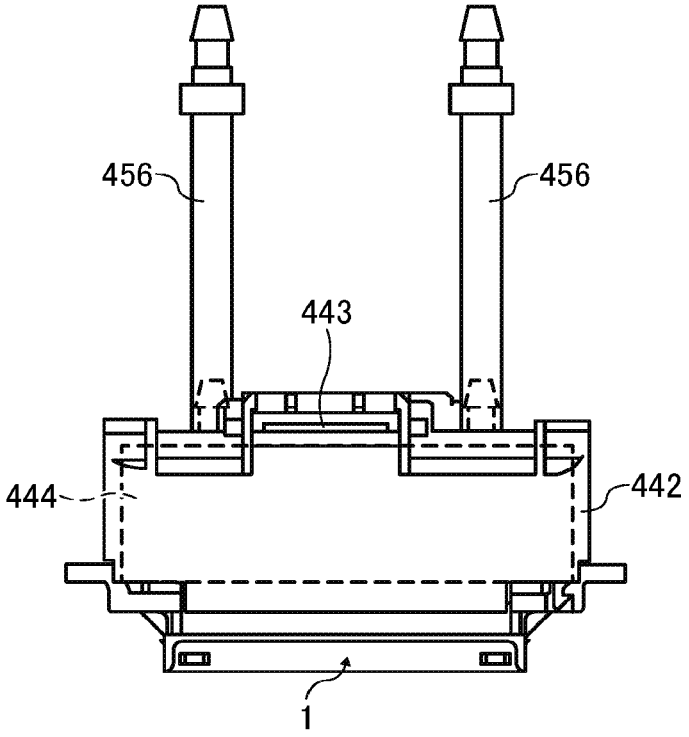
FIG. 10 is a schematic front view of still another example of the liquid discharge device according to the present disclosure.

FIG. 10 is a front view of still another example of the liquid discharge device 440. The liquid discharge device 440 includes tubes 456 connected to the head 1 mounting a channel part 444 so that the head 1 and a supply unit form a single unit. The liquid in a liquid storage source such as an ink cartridge is supplied to the head 1 through the tube 456. Further, the channel part 444 is disposed inside a cover 442. Instead of the channel part 444, the liquid discharge device 440 may include the head tank 441. A connector 443 electrically connected with the head 1 is provided on an upper part of the channel part 444.

The main scan moving unit 493 may be a guide only. The supply unit may be a tube(s) only or a loading unit only.

Figure 11:
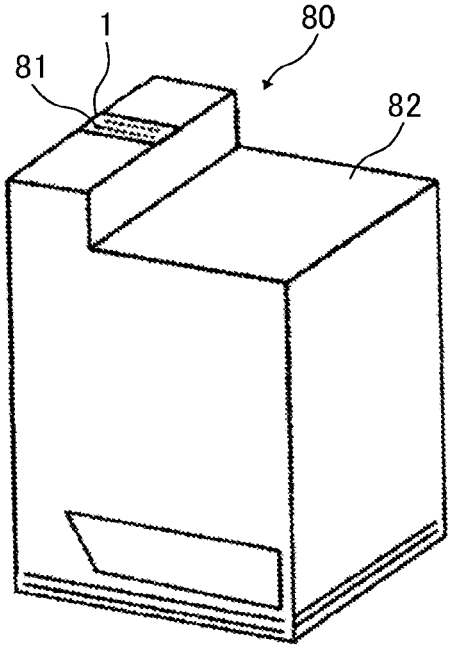
FIG. 11 is a perspective view of an example of a liquid cartridge.

Further, as an example of the liquid discharge device 440, there is an ink cartridge 80 (liquid cartridge) in which the head 1 according to the present disclosure and an ink tank 82 to supply the liquid (ink) to the head 1 forms a single unit (see FIG. 11). According to the above-described embodiment, a high-quality liquid cartridge having excellent durability and reliability can be obtained.

FIG. 11 is a perspective view of an example of an ink cartridge 80. The ink cartridge 80 includes the head 1 and an ink tank 82 so that the head 1 and the ink tank 82 form a single body. Nozzles 81 are formed in a nozzle surface 310 of the head 1. The ink tank 82 supplies ink to the head 1. The ink cartridge 80 includes the head 1 and the ink tank 82 that forms a single unit. Thus, an actuator of the head 1 is made to be highly precise, highly densified, and highly reliable to improve yield and reliability of the ink cartridge 80. Thus, the head 1 according to the present disclosure can reduce a cost of the ink cartridge 80.

[Liquid Discharge Apparatus]

In the above-described embodiments, the "liquid discharge apparatus" includes the head or the liquid discharge device and drives the head to discharge liquid. The liquid discharge apparatus may be, for example, an apparatus capable of discharging liquid to a material to which liquid can adhere and an apparatus to discharge liquid toward gas or into liquid.

The "liquid discharge apparatus" may include devices to feed, convey, and eject the material on which liquid can adhere. The liquid discharge apparatus may further include a pretreatment apparatus to coat a treatment liquid onto the material, and a post-treatment apparatus to coat a treatment liquid onto the material, onto which the liquid has been discharged.

The "liquid discharge apparatus" may be, for example, an image forming apparatus to form an image on a sheet by discharging ink, or a three-dimensional fabrication apparatus to discharge a fabrication liquid to a powder layer in which powder material is formed in layers to form a three-dimensional fabrication object.

The "liquid discharge apparatus" is not limited to an apparatus to discharge liquid to visualize meaningful images, such as letters or figures. For example, the liquid discharge apparatus may be an apparatus to form arbitrary images, such as arbitrary patterns, or fabricate three-dimensional images.

The above-described term "material on which liquid can be adhered" represents a material on which liquid is at least temporarily adhered, a material on which liquid is adhered and fixed, or a material into which liquid is adhered to permeate.

Examples of the "material on which liquid can be adhered" include recording media, such as paper sheet, recording paper, recording sheet of paper, film, and cloth, electronic part, such as electronic substrate and piezoelectric element, and media, such as powder layer, organ model, and testing cell. The "material on which liquid can be adhered" includes any material on which liquid is adhered, unless particularly limited.

Examples of the "material on which liquid can be adhered" include any materials on which liquid can be adhered even temporarily, such as paper, thread, fiber, fabric, leather, metal, plastic, glass, wood, and ceramic.

Further, "liquid" discharged from the head is not particularly limited as long as the liquid has a viscosity and surface tension of degrees dischargeable from the head. However, preferably, the viscosity of the liquid is not greater than 30 mPa·s under ordinary temperature and ordinary pressure or by heating or cooling.

Examples of the liquid include a solution, a suspension, or an emulsion that contains, for example, a solvent, such as water or an organic solvent, a colorant, such as dye or pigment, a functional material, such as a polymerizable compound, a resin, or a surfactant, a biocompatible material, such as DNA, amino acid, protein, or calcium, or an edible material, such as a natural colorant.

Such a solution, a suspension, or an emulsion can be used for, e.g., inkjet ink, surface treatment solution, a liquid for forming components of electronic element or light-emitting element or a resist pattern of electronic circuit, or a material solution for three-dimensional fabrication.

The "liquid discharge apparatus" may be an apparatus to relatively move the head and a material on which liquid can be adhered. However, the liquid discharge apparatus is not limited to such an apparatus. For example, the liquid discharge apparatus may be a serial head apparatus that moves the head or a line head apparatus that does not move the head.

Examples of the "liquid discharge apparatus" further include a treatment liquid coating apparatus to discharge a treatment liquid to a sheet surface to coat the sheet with the treatment liquid to reform the sheet surface and an injection granulation apparatus to discharge a composition liquid including a raw material dispersed in a solution from a nozzle to mold particles of the raw material.

Figure 12:
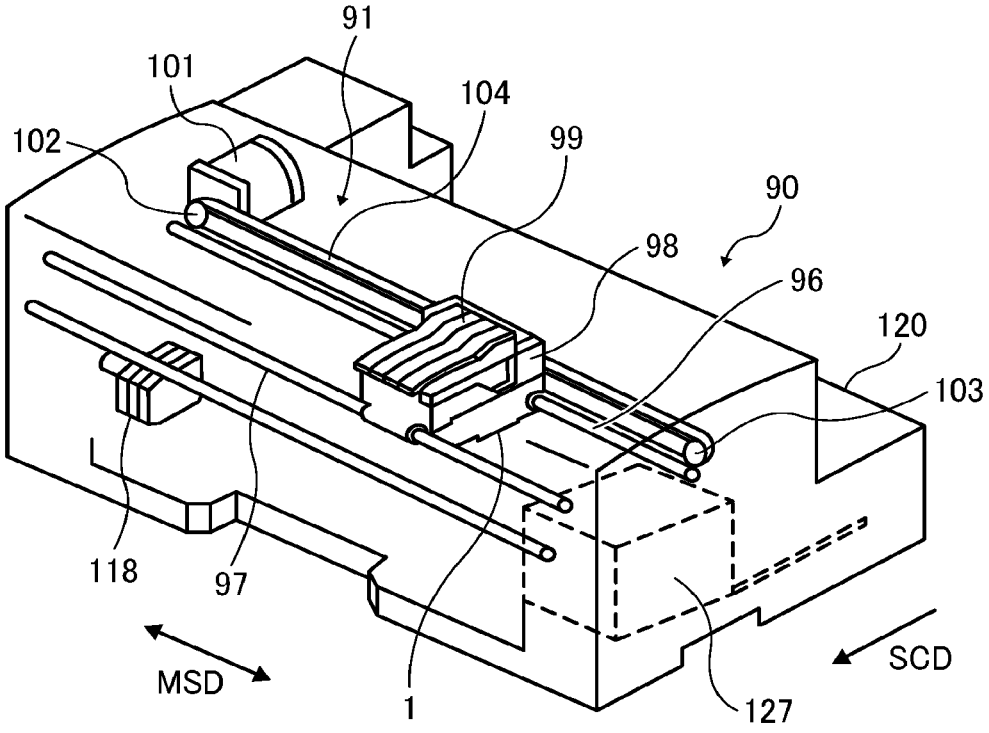
FIG. 12 is a perspective view of an example of a liquid discharging apparatus according to the present disclosure.
Figure 13:
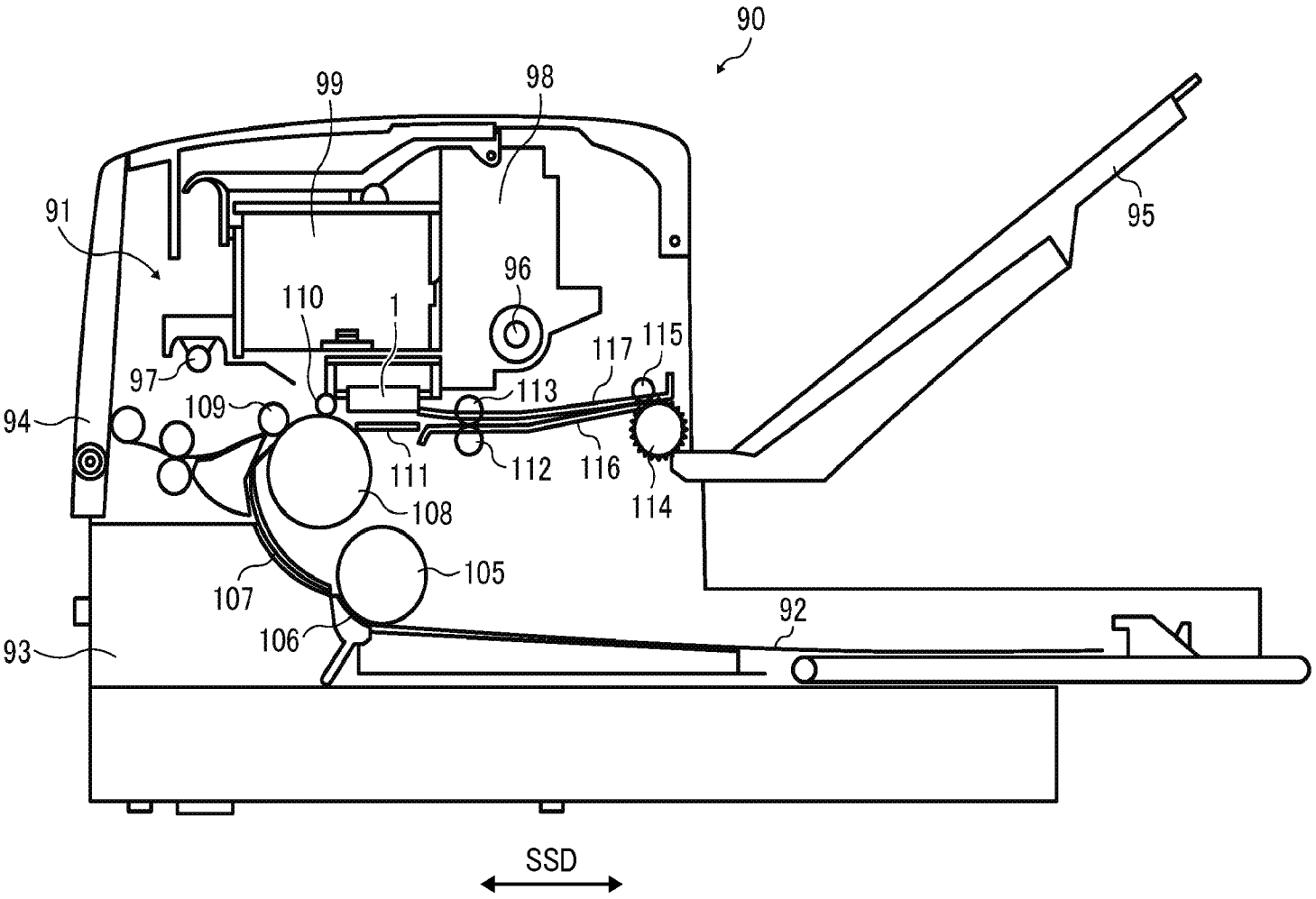
FIG. 13 is a side view of the example of the liquid discharging apparatus according to the present disclosure.

FIGS. 12 and 13 illustrate an inkjet recording apparatus 90 that is an example of a liquid discharge apparatus including the head 1 or liquid discharge device 440. FIG. 12 is a perspective view of the inkjet recording apparatus 90. FIG. 13 is a side view of a mechanical section of the inkjet recording apparatus 90 of FIG. 12. The head 1 is identical to the head 1 illustrated in FIGS. 1 to 7.

The inkjet recording apparatus 90 includes a printing assembly 91 inside an apparatus body 120. The printing assembly 91 includes a carriage 98, the head 1 mounted on the carriage 98, an ink cartridge 99 to supply ink to the head 1. The carriage 98 is movable in a main scanning direction as indicated by arrow "MSD" in FIG. 12.

A sheet feeding cassette 93 (or a sheet feeding tray) capable of loading a large number of sheets 92 from a front side of the apparatus body 120 is detachably attached to the lower part of the apparatus body 120. In addition, the inkjet recording apparatus 90 includes a bypass tray 94 openable to manually feed the sheets 92. Further, the sheets 92 fed from the sheet feeding cassette 93 or the bypass tray 94 is taken in, the required image is recorded by the printing assembly 91, and then ejected to the sheet ejection tray 95 mounted on a rear side of the apparatus body 120.

The printing assembly 91 holds the carriage 98 with a main guide rod 96 and a sub-guide rod 97 so that the carriage 98 is slidable in the main scanning direction MSD. The main guide rod 96 and the sub-guide rod 97 are guides laterally bridged between left and right-side plates.

The heads 1 to discharge ink droplets of respective colors of yellow (Y), cyan (C), magenta (M), and black (Bk) are mounted on the carriage 98 so that a plurality of ink discharge ports (nozzles 6) is arrayed in a direction intersecting the main scanning direction MSD. The heads 1 are mounted on the carriage 98 such that the head 1 discharges ink droplets downward. Further, the ink cartridges 99 to supply ink of each color to the head 1 are exchangeably mounted on the carriage 98.

Each of the ink cartridges 99 includes an air communication port communicated with the atmosphere in an upper portion of each ink cartridges 99, an ink supply port in a lower portion of each ink cartridges 99 to supply ink to the head 1, and a porous body to be filled with ink inside each ink cartridge 99. The ink supplied to the head 1 is maintained at a slight negative pressure by the capillary force of the porous body in the ink cartridges 99. Although four heads 1 of respective colors are used as the head 1, the head 1 may be a single head having nozzles 6 discharging ink droplets of each colors.

The carriage 98 is slidably fitted on the main guide rod 96 on the rear side (downstream side in a sheet conveyance direction) and slidably mounted on the sub-guide rod 97 on the front side (upstream side in the sheet conveyance direction). To scan the carriage 98 in the main scanning direction MSD, a timing belt 104 is stretched between a driving pulley 102 driven and rotated by a main scanning motor 101 and a driven pulley 103. The timing belt 104 is secured to the carriage 98. The carriage 98 is reciprocally moved by forward and reverse rotations of the main scanning motor 101.

The inkjet recording apparatus 90 further includes a sheet feed roller 105, a friction pad 106, a sheet guide 107, a conveyance rollers 108 and 109, and a leading end roller 110 to convey the sheet 92, which is set in the sheet feeding cassette 93, to a portion below the heads 1. The sheet feed roller 105 and the friction pad 106 separates and feeds the sheets 92 sheet by sheet from the sheet feeding cassette 93.

The sheet guide 107 guides the sheets 92. The conveyance roller 108 reverses and conveys the sheet 92 fed from the sheet feed roller 105. The conveyance roller 109 is pressed against a circumferential surface of the conveyance roller 108. The leading end roller 110 defines an angle at which the sheet 92 is fed from the conveyance rollers 108 and 109. The conveyance roller 108 is driven to rotate via a gear train by a sub-scanning motor 118.

A print receiver 111 as a sheet guide is provided to guide the sheet 92 fed from the conveyance roller 108 below the heads 1 in accordance with the movement range of the carriage 98 in the main scanning direction MSD. On a downstream side of the print receiver 111 in the sheet conveyance direction (sub-scanning direction indicated by arrow SSD in FIG. 12), the inkjet recording apparatus 90 includes a conveyance roller 112, a spur roller 113, a sheet ejection roller 114, a spur roller 115, and guides 116 and 117. The conveyance roller 112 is driven to rotate with the spur roller 113 to feed the sheet 92 in a sheet ejection direction. The sheet ejection roller 114 and the spur roller 115 further feed the sheet 92 to the sheet ejection tray 95. The guides 116 and 117 form a sheet ejection path.

In recording, the inkjet recording apparatus 90 drives the head 1 in response to image signals while moving (scanning) the carriage 98, discharges ink to the stopped sheet 92 to record one line of a desired image onto the sheet 92, and feeds the sheet 92 in a predetermined amount, and then records a next line on the sheet 92. When the inkjet recording apparatus 90 receives a signal indicating that a rear end of the sheet 92 has reached a recording area or an end of recording operation, the inkjet recording apparatus 90 terminates a recording operation and ejects the sheet 92.

Further, the recovery device 127 to recover a discharge failure of the head 1 is disposed at a position out of the recording area on a right side in the moving direction (main scanning direction MSD) of the carriage 98. The recovery device 127 includes a cap, a suction unit, and a cleaning unit. In printing standby state, the carriage 98 is moved and placed at the side in which the recovery device 127 is disposed, and the heads 1 are capped with the capping unit.

Accordingly, the nozzles 6 are maintained in a wet state, thus preventing occurrence of a discharge failure due to ink dry. The inkjet recording apparatus 90 discharges ink not relating to the recording in the middle of the recording, for example, to maintain the viscosity of ink in all of the nozzles 6 constant, thus maintaining the head 1 to stably discharge the liquid (ink).

When a discharge failure has occurred, the nozzles 6 of the heads 1 are tightly sealed with the cap, the suction unit sucks ink and bubbles, for example, from the nozzles 6 via tubes, and the cleaning unit removes ink and dust adhered to the nozzle surface 310 of the nozzles 6, thus recovering the discharge failure. The sucked ink is discharged to a waste ink container disposed on a lower portion of an apparatus body 120, and is absorbed into and retained in an ink absorber in the waste ink container.

The inkjet recording apparatus 90 mounts the heads 1 manufactured by the method according to the present disclosure. Thus, the heads 1 can stably discharge the ink droplets and thus increase the image quality.

Although the above-described embodiments describes the head 1 used to the inkjet recording apparatus 90, the head 1 may be used to a device that discharges liquid other than ink, for example, a liquid resist for patterning.

EXAMPLES

Hereinafter, the present disclosure is described with reference to examples and comparative examples. However, the present disclosure is not limited to the examples as described below.

Example 1

An Examples 1 is indicated as "EX1" in Table 1.

The diaphragm 3 and the piezoelectric element 2 are formed on the actuator substrate 100 made of silicon (Si) as illustrated in FIGS. 1 to 3. Further, the interlayer insulating film 45, the connection hole 30, the wiring pattern 42, the lead wire 40, and the lead wiring pad 41 are formed on the actuator substrate 100.

Next, through holes 60 and gaps 67 were formed by a photolithographic etching method on the sub-frame substrate 200 made of silicon (Si), and the sub-frame substrate 200 and the actuator substrate 100 were bonded. Next, the actuator substrate 100 was processed by dry etching using an ICP etcher and $CF_4$ gas to form the pressure chamber 5.

Next, the $O_2$ plasma processing (50 W for five minutes) was performed in the ICP etcher to form a natural oxide film 32 having a film thickness of 3.5 nm in a portion to be a liquid channel.

Next, a surface treatment film 52 is formed by atomic layer deposition (ALD) method. A support tape was attached to a portion at which the surface treatment film 52 was not formed by the ALD method. The sub-frame substrate 200, to which the support tape was attached, was placed into an ALD chamber, and a first layer of $SiO_2$ film was formed to a film thickness of 0.1 nm.

Then, a $Ta_2O_5$ film was formed on the first layer of $SiO_2$ film, and a $SiO_2$ film and a $Ta_2O_5$ film were alternately formed on the $Ta_2O_5$ film. The film thickness of the surface treatment film 52 was 50 nm.

Further, the $O_3$ plasma processing (treatment) was performed for 5 minutes in the ALD chamber during the process of ALD method. The $O_3$ plasma processing (treatment) was performed during film-forming the surface treatment film 52 in ALD chamber.

After forming the surface treatment film 52, a cross-section of the surface treatment film 52 is observed by Transmission Electron Microscope (TEM), and a thickness of the natural oxide film 32 on the Si substrate was measured. At this time, Energy Dispersive X-ray Spectroscopy (EDX) analysis was performed at the interface between the natural oxide film 32 and the surface treatment film 52 to quantify the C content and F content to all elements (mainly Si, Ta, O, C, and F).

Further, the observation result in the present disclosure is illustrated in FIG. 7.

Further, X-ray Photoelectron Spectroscopy (XPS) analysis was performed. Then, it was observed that the interface between the natural oxide film 32 and the surface treatment film 52 contains TaSiOx that is a film obtained in a bonded state of Ta—Si.

Next, a natural oxide film 32 and a surface treatment film 52 were formed on the nozzle substrate 300 in which the nozzles 6 were formed under the same manufacturing conditions as described above. Subsequently, the nozzle substrate 300 is bonded to the actuator substrate 100 obtained by the above-described process by adhesive. The head 1 of the Example 1 was thus produced.

Examples 2 to 6 and Comparative Examples 1 to 4

Examples 2 to 6 were same as Example 1 except that changes were made as illustrated in Table 1 below. Examples 2 to 6 are indicated as "EX2" to "EX6" in Table 1. Further, Comparative Examples 1 to 4 are indicated as "CE1" to "CE4" in Table 1.

[Evaluation]

[Scratch Strength]

The scratch strength was evaluated on adhesion of the surface treatment film 52. A scratch tester (CSR-5000 manufactured by RHESCA Co., LTD.) was used to test the scratch strength. The adhesion differs according to a condition of a diamond tip (head) used to scratch the surface treatment film 52. In the evaluation, diameter of stylus was 15 μm using a spherical diamond tip. The adhesion was preferably 20 mN or more.

[Reliability Test]

A heat cycle test (HTC) under temperature cycles (9 cycles) from −70° C. to ° C. were performed for the reliability test using the inkjet recording apparatus 90 as illustrated in FIGS. 12 and 13. After the HTC test, the discharge properties of the head 1 were evaluated to check presence of a defect in the head 1.

[Evaluation Criteria]

GOOD: No discharge failure occurred.

POOR: Discharge failure occurred.

Table 1 illustrates preparation conditions, measured values, and evaluation results of each example and comparative example. In Table 1, "%" means "atomic %".

TABLE 1

| | $O_2$ Plasma Processing Condition | | $O_3$ Plasma Processing Condition | Natural Oxide Film | Surface Treatment Film | Contents of Impurities in Interface | | | |
|---|---|---|---|---|---|---|---|---|---|
| | PW (W) | TIME (min) | TIME (min) | Film Thickness (nm) | First Layer of $SiO_2$ (nm) | C (atomic %) | F (atomic %) | Scratch Strength (mN) | Reliability Test |
| EX1 | 50 | 5 | 5 | 3.5 | 0.1 | 4.0 | 2.0 | 35 | GOOD |
| EX2 | 50 | 10 | 5 | 4.2 | 0.1 | 3.9 | 1.0 | 45 | GOOD |
| EX3 | 60 | 10 | 5 | 4.9 | 0.1 | 3.6 | 0.50 | 60 | GOOD |

TABLE 1-continued

| | $O_2$ Plasma Processing Condition | | $O_3$ Plasma Processing Condition | Natural Oxide Film Film | Surface Treatment Film First Layer | Contents of Impurities in Interface C | F | Scratch | |
|---|---|---|---|---|---|---|---|---|---|
| | PW (W) | TIME (min) | TIME (min) | Thickness (nm) | of $SiO_2$ (nm) | (atomic %) | (atomic %) | Strength (mN) | Reliability Test |
| EX4 | 50 | 5 | 8 | 4.4 | 0.1 | 1.3 | 1.90 | 60 | GOOD |
| EX5 | 30 | 5 | 5 | 2.2 | 0.1 | 4.50 | 3.60 | 20 | GOOD |
| EX6 | 60 | 10 | 5 | 4.9 | 3.2 | 3.50 | 0.60 | 85 | GOOD |
| CE1 | None | None | None | 0.8 | 0.1 | 8.20 | 6.30 | 10 | POOR |
| CE2 | None | None | 5 | 1.5 | 0.1 | 6.20 | 6.10 | 14 | POOR |
| CE3 | 50 | 5 | None | 1.7 | 0.1 | 6.30 | 2.50 | 15 | POOR |
| CE4 | None | None | None | 0.7 | 5.1 | 9.30 | 6.90 | 13 | POOR |

In Table 1, the scratch strength tends to be higher as contents of impurities in the interface are reduced. If the contents of impurities in the interface exceeds 5 atomic %, the scratch strength falls below 20 mN. In the subsequent reliability test, discharge failure occurred due to peeling of the surface treatment film.

Numerous additional modifications and variations are possible in light of the above teachings. Such modifications and variations are not to be regarded as a departure from the scope of the present disclosure and appended claims, and all such modifications are intended to be included within the scope of the present disclosure and appended claims.

What is claimed is:

1. A liquid discharge head comprising:

a channel forming member made of silicon, the channel forming member including a plurality of liquid channels;

a natural oxide film having a film thickness of 2 nm or more on an outermost surface of the plurality of liquid channels of the channel forming member; and a surface treatment film on the natural oxide film to contact the natural oxide film, wherein each of a carbon content and a fluorine content in an interface between the natural oxide film and the surface treatment film is 5 atomic % or less.

2. The liquid discharge head according to claim 1, wherein the surface treatment film includes an oxide film containing silicon; and the interface between the natural oxide film and the surface treatment film is siloxane bonded.

3. The liquid discharge head according to claim 1, wherein the surface treatment film contains at least one transition metal selected from fourth group and fifth group.

4. The liquid discharge head according to claim 3, wherein the surface treatment film contains at least one of Hf, Ta, and Zr.

5. The liquid discharge head according to claim 1, wherein a film thickness of the surface treatment film is 30 nm or more and 100 nm or less.

6. The liquid discharge head according to claim 1, wherein the surface treatment film includes a first layer of a $SiO_2$ film on the interface between the natural oxide film and the surface treatment film.

7. The liquid discharge head according to claim 6, wherein the surface treatment film includes the first layer of the $SiO_2$ film on the natural oxide film on an outermost surface of the channel forming member.

8. The liquid discharge head according to claim 6, wherein the surface treatment film includes a $SiO_2$ film and a $Ta_2O_5$ film that are alternately laminated on the first layer of the $SiO_2$ film.

9. The liquid discharge head according to claim 6, wherein a film thickness of the first layer of the $SiO_2$ film is 0.1 nm or more and 10 nm or less.

10. The liquid discharge head according to claim 6, wherein the natural oxide film contains $SiO_2$.

11. The liquid discharge head according to claim 1, wherein the surface treatment film has a Ta—Si bonding.

12. A liquid discharge device comprising the liquid discharge head according to claim 1.

13. The liquid discharge device according to claim 12, further comprising at least one of:

a head tank to store liquid to be supplied to the liquid discharge head;

a carriage to mount the liquid discharge head;

a supply device to supply the liquid to the liquid discharge head;

a maintenance device to maintain the liquid discharge head; and a drive device to move the carriage in a main scanning direction, together with the liquid discharge head to form a single unit.

14. A liquid discharge apparatus comprising the liquid discharge device according to claim 12.

* * * * *